US008844734B2

(12) United States Patent
Hokanson

(10) Patent No.: US 8,844,734 B2
(45) Date of Patent: Sep. 30, 2014

(54) COMPACT PORTABLE AUGER RACK FOR SINGLE-OPERATOR FUNCTION

(76) Inventor: Craig Richard Hokanson, Farmington, UT (US)

( * ) Notice: Subject to any disclaimer, the term of this patent is extended or adjusted under 35 U.S.C. 154(b) by 543 days.

(21) Appl. No.: 13/052,087

(22) Filed: Mar. 20, 2011

(65) Prior Publication Data

US 2012/0234780 A1 Sep. 20, 2012

(51) Int. Cl.
*A47F 7/00* (2006.01)

(52) U.S. Cl.
USPC ..... 211/70.6

(58) Field of Classification Search
USPC ..... 211/60.1, 62, 64, 68, 69, 69.1, 70.2, 211/70.5, 70.8, 70.7, 70.6, 85.7, 70.4, 211/41.14, 41.15
See application file for complete search history.

(56) References Cited

U.S. PATENT DOCUMENTS

| | | | | |
|---|---|---|---|---|
| 3,895,726 | A * | 7/1975 | Rassieur | 414/522 |
| 3,918,536 | A * | 11/1975 | Deeter et al. | 175/85 |
| 3,983,949 | A * | 10/1976 | Pozniko | 175/85 |
| 4,696,461 | A * | 9/1987 | Zelinski | 269/16 |
| 6,416,134 | B1 * | 7/2002 | Share et al. | 299/55 |
| 6,681,470 | B1 * | 1/2004 | Scott | 29/434 |
| 6,817,477 | B2 * | 11/2004 | McMurray et al. | 211/4 |
| 2010/0308093 | A1 * | 12/2010 | Johnson | 224/408 |

FOREIGN PATENT DOCUMENTS

JP 07207658 A * 8/1995 ..... E02D 5/18

* cited by examiner

*Primary Examiner* — Jerry Redman
(74) *Attorney, Agent, or Firm* — Steven Rinehart

(57) ABSTRACT

A portable auger rack is disclosed, adapted to allow a single operator to transport a plurality of augers and an auger drive unit, as well as to allow a single operator to connect the drive unit and augers unassisted to a skid-steer, Bobcat®, or other variation of track equipment.

10 Claims, 5 Drawing Sheets

COMPACT PORTABLE AUGER RACK FOR SINGLE-OPERATOR FUNCTION

BACKGROUND OF THE INVENTION

1. Field of the Invention

This invention relates to construction equipment, and more particularly relates to transporting and storing augers used in drilling earth in connection with construction.

2. Description of the Related Art

Augers and auger drive units are well-known in the art. Earth augers comprise sharp helical tools used in drilling to extract earth and aggregate from a construction area. Augers are also used to facilitate the construction of wells, the installation of piping, and the like. Augers are used in a various apparatii to move fluids, gravel, grain, snow, oil, and the like, from one position to another.

In construction, standard augers, which are used to drill holes in earth, can range from just a few inches in diameter to more than four feet in diameter. These augers often comprise sharp bits detachably connected to the forward end of the auger for engaging rock and other aggregates. The augers themselves can weigh hundreds of pounds or more, and are cumbersome to transport from one location to another. Because of their size, it is difficult to transport a plurality of augers simultaneously, and there exists no efficient means in the art of stores or securing augers during transport, much less means of doing so by a single human operator. Additionally, auger drive units are necessary for operation of heavy augers. These auger drive units comprise electro-mechanical, hydraulic motors, usually affixable to a skid steer, backhoe, mini excavator, compact track loader, Bobcat®, or any of a plethora of various types of tractors and track vehicles.

Using current methods, systems, and apparatii, at a minimum, two to three operators are needs to transport, secure, stabilize and ready a track vehicle, auger drive unit, and an auger for drilling. It can be very dangerous for a single operator, or even two operators, to attempt to ready the auger, track vehicle, and auger drive unit alone.

It is therefore desirable that a portable, compact auger rack be provided which can be managed by a single human operator.

SUMMARY OF THE INVENTION

From the foregoing discussion, it should be apparent that a need exists for portable, compact auger rack for single-operator function. Beneficially, such an apparatus would overcome many of the difficulties with prior art by providing a means for securing, transporting, and reading augers for drilling.

The present invention has been developed in response to the present state of the art, and in particular, in response to the problems and needs in the art that have not yet been fully solved by currently available information management systems. Accordingly, the present invention has been developed to provide a portable auger rack for transporting augers, the portable auger rack comprising: a generally rectangular frame comprising: an elongated forward member between 0.5 meters and 5 meters in length, the forward member formed from a rigid metallic substance, the forward member permanently affixed to one or more of a right side member and a left side member; an elongated rear member between 0.5 meters and 5 meters in length, the rear member formed from a rigid metallic substance, the rear member permanently affixed to one or more of the right side member and the left side member.

The right side member is permanently disposed within the frame in generally parallel orientation to the left side member, the right side member permanently affixed to the forward member at an angle of between 30 and 120 degrees, the right side member permanently affixed to the rear member at an angle of between 30 and 120 degrees.

The left side member in a generally parallel orientation to the right side member, the left side member permanently affixed to the forward member at an angle of between 30 and 120 degrees, the left side member permanently affixed to the rear member at an angle of between 30 and 120 degrees; one or more cylindrical receptacle(s), with open top(s), for receiving a tip of an auger, each of the receptacles permanently affixed at their base to one of the rear member, the forward member, the left side member, and the right side member.

The auger rack further comprises one or more rigid elongated arm(s), each arm pivotably affixed to a component of the auger rack, wherein each arm extends laterally above the frame from its point of affixation to a distal point above a receptacle; and one or clasp(s), each clasp affixed to an arm, each clasp for detachably gripping an auger resting in a receptacle.

The auger rack may further comprise two vertically oriented U-shaped channels for receiving and securing a cradle of an auger drive unit, wherein the U-shaped channels are permanently affixed to the frame.

One or more arms may be pivotably connected to a U-shaped channel. The auger rack may further comprise a plurality of elongated support members, the support members each affixed at a proximal end to the frame, the support members each affixed at a distal end to an arm. The left side member and right side member may each respectively define a hollow recess for receiving a fork of a fork lift.

The auger rack may further comprise or more housing(s) affixed to the frame, each housing defining a hollow recess for receiving a fork of a fork lift. The auger rack may further comprise or more crossbeam(s), each crossbeam affixed to two or more of the forward member, the rear member, the left side member and the right side member.

The auger rack may further comprise or more plinth(s) affixed to an underside of the frame for engaging ground, wherein the plinth(s) are formed from one of hydrocarbons and steel. The auger rack may further comprise or more plinth(s) affixed to an underside of the frame for engaging ground.

A second auger rack is also disclosed comprising: a frame comprising: an elongated forward member, the forward member formed from a rigid substance, the forward member permanently affixed to one or more of a right side member and a left side member; and an elongated rear member, the rear member formed from a rigid substance, the rear member permanently affixed to one or more of the right side member and the left side member.

The frame further comprises the right side member; wherein the right side member is permanently disposed within the frame in generally parallel orientation to the left side member, the right side member permanently affixed to the forward member at approximately a right angle, the right side member permanently affixed to the rear member at approximately a right angle; the left side member, wherein the left side member in a generally parallel orientation to the right side member, the left side member permanently affixed to the forward member at approximately a right angle, the left side member permanently affixed to the rear member at approximately a right angle.

The auger rack further comprises one or more receptacle(s), with open top(s), for receiving a tip of an auger, each of the receptacle(s) permanently affixed at their base to one of the rear member, the forward member, the left side member, and the right side member; one or more rigid elongated arm(s), each arm detachably affixed to a component of the auger rack, wherein each arm extends laterally above the frame from its point of affixation to a distal point above a receptacle; and one or clamp(s), each clamp affixed to an arm, each clamp for engaging an auger.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
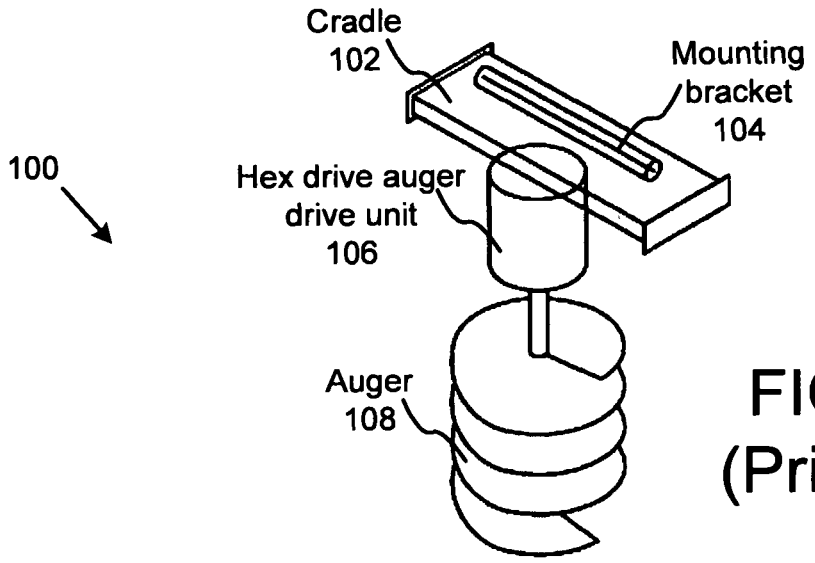
FIG. 1A (Prior Art)
FIG. 1A is a side elevational perspective view an quick attached hitch, auger and auger drive unit known in the prior art.

FIG. 1A is a side elevational perspective view a quick attach hitch, auger and auger drive unit 100 known in the prior art. The auger drive unit 100 unit comprises a cradle 102, a mounting bracket 104, and a hex derive auger drive unit 106. The auger drive unit 106 is detachably connected to the proximal end of the auger 108.

The cradle 102, mounting bracket 104, auger drive unit 106, and auger 108 are well-known to those of skill in the art.

The mounting bracket 104 is used to detachably mount the auger drive unit 100 to a track vehicle.

The auger drive unit 106 shown comprises a hex drive, but may also comprise a round drive. The output torque of the drive unit 106 can vary between 100 ft. lbs and 35,000 ft. lbs, and the output speed of the drive unit 106 may vary from 10 rpm to 1,000 rpm.

Figure 1B:
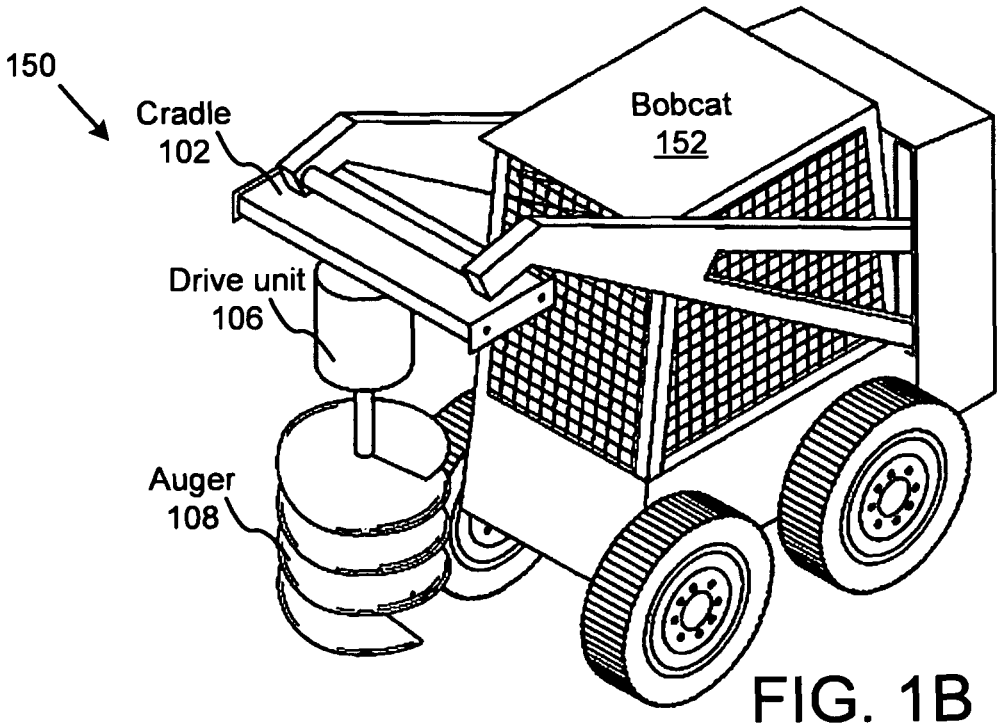
FIG. 1B (Prior Art)
FIG. 1B is a side elevational perspective environmental view an auger drive unit attached to a Bobcat® known in the prior art.

FIG. 1B is a side elevational perspective environmental view an auger drive unit 150 attached to a Bobcat®.

The auger drive unit 150, Bobcat 152 and auger 108 all known in the prior art. The auger drive unit may comprise either a hex drive or round drive as known to those of skill in the art.

Figure 2:
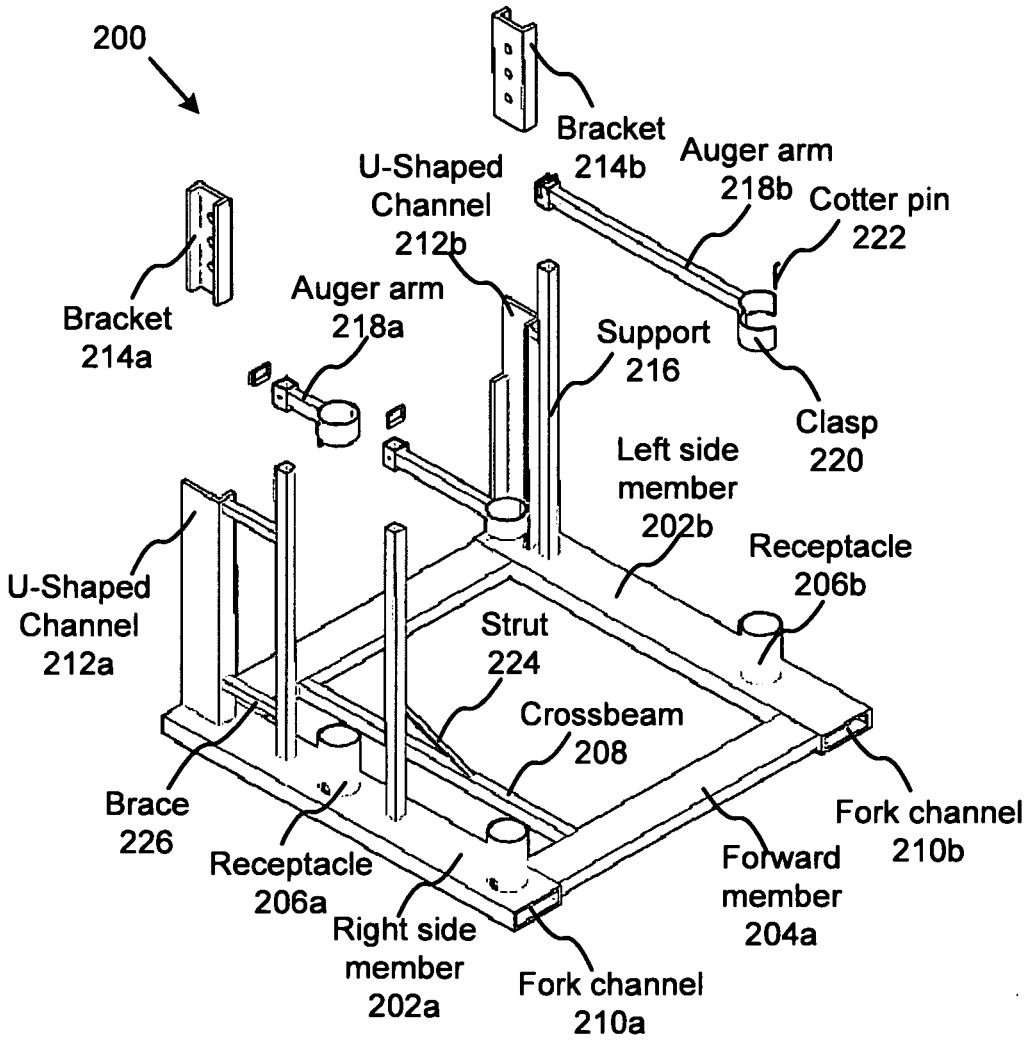
FIG. 2 is an elevational perspective view an auger rack in accordance with the present invention.

FIG. 2 is an elevational perspective view an auger rack 200 in accordance with the present invention. The auger rack 200 comprises, in the shown embodiment, a right side member 202*a*, a left side member 202*b*, a forward member 204*a*, a rear member 204*b*, a receptacle 206*a*, a receptacle 206*b*, a cross-beam 208, a fork channel 210*a*, a fork channel 210*b*, a U-shaped channel 212*a*, a U-shaped channel 212*b*, a bracket 214*a*, a bracket 214*b*, a support 216, an auger arm 218*a*, an auger arm 218*b*, a clasp 220, a cotter pin 222, and a strut 224.

The frame consists of the right side member 202*a*, the left side member 204*b*, the forward member 204*a*, and the rear member 204*b* (the frame components collectively referred to hereinafter as the "members 202-204"). These members 202-204 are affixed, or welded to one another, at generally right angles to form the frame.

Each of the members 202-204, in the shown embodiment, comprise elongated, hollow steel tubes. Each of the members 202-204 may alternatively comprise rods, beams, plates, or pipes. Each of the members 202-204 may alternatively comprise cubic-shaped polymer housings. The members 202-204 may comprise a number of holes, bores, or apertures drilled through the members 202-204 for securing aftermarket components to the auger rack 200. These apertures may be circular in shape and serves the purpose of receiving a detachable receptacle 206.

The members 202-204 may be manufactured from polymers, wood, metals, alloys, and the like. The member 202-204 may be curved, bent, or angled along either the y-axis or an orthogonal x-axis.

The members 202-204 collectively form the frame, or chassis, of the auger rack 200. The members 202-204 may be cubic or cylindrical in shape. In the shown embodiment, the frame is rectangular ("rectangular" defined herein to include the square shape) from a top perspective view looking down a y-axis. In alternative embodiments, the frame, from this perspective, may be circular, elliptical, triangular, polygonal, or otherwise.

The members 202-204 may comprises a plurality of apertures for receiving supports 216 and/or U-shaped channels 212*a-b* and/or one of the forward member 204*a*, the rear member, the right side member 202*a*, and/or the left side member 202*b*.

The receptacles 206*a-b*, in the shown embodiment, comprise cup-like, open-topped, housings for receiving either the tip of an auger 108, or an auger tip detachably affixed to an auger 108. In either case, the auger 108 is secured, or constructively secured, by auger rack 200 as further illustrated below in relation to FIGS. 3 and 5.

The receptacles 206*a-b* may be permanently or detachably affixed to any of the members 202-204, or one or more cross-beam(s) 208. The receptacles may be made of steel, wood, and/or polymers, and may comprise baskets, cups, cylinders, cubes, or any other three-dimensional shape with an open top or open upper surface. In some embodiments, the receptacles may comprise clasps or rings which grip the auger 108 laterally from the side.

The crossbeam 208 comprises an additional member, like each of members 202-204, which is used to further stabilize and strengthen the auger rack 200. In the shown embodiment, the crossbeam 208 is affixed to both the forward member 204*a* and the rear member 204*b*. In alternative embodiments, the crossbeam 208 may be affixed to any combination of two of the members 202-204. In the preferred embodiment, the crossbeam 208 is welded to two of the members 202-204.

In the shown embodiment, the right side member 202*a* and the left side member 202*b* both comprise open forward and rear ends. The right side member 202*a* and the left side member 202*b* both define hollow recesses, or cavities, into which the fork of a fork lift can be inserted for lifting, moving and transporting the auger rack 200. Forks, and fork lifts, are well-known to those of skill in the art.

In alternative embodiments, additional fork housing are permanently affixed to one or more of the members 202-204, either above or below the frame, for receiving one or more forks.

The U-shaped channels 212*a-b* comprise elongated beams, affixed at a proximal end to one of the members 202-204 and affixed to nothing at an opposing distal end. The U-shaped channels 212*a-b* each comprise a u-shaped channel, surrounded on three sides by the beam and open on a fourth side. The open sides of the U-shaped channels 212*a-b* face one another when the u-shaped channels are affixed to the auger rack 200. The U-shaped channels face one another at a predetermined distance of separation, such that a cradle 102, or chassis affixed to an auger drive unit 106, may be slid downwardly between the U-shaped channels 212*a-b*, such that the cradle 102 is secured laterally within the U-shaped channels 212*a-b*. This distance of separation may vary from 0.1 meters to 10 meters.

In some embodiments, brackets 214*a-b* are secured within the U-shaped channels 212*a-b*, and the brackets 214*a-b* and screwably attached to a cradle 102 or an auger drive unit 106. The brackets 214*a-b* may be first detachably secured to the cradle 102, mounting bracket 104, or other components of an auger drive unit 106 or its incidental components. The brackets 214*a-b* may be tapered at either or both ends to more easily facilitate insertion of the brackets 214*a-b* into the U-shaped channels 212*a-b* by a machine such as a fork lift, Bobcat, or track vehicle.

The U-shaped channels may secured or hold a quick attach hitch, such as quick attach hitch 100.

In some embodiments, the auger rack 200 further comprises bolts, buckles, sleeves, sleeve pins, claps or other locking mechanisms for locking the auger drive unit 106, or quick attach hitch 100, in place one it is secured within the U-shaped channels 212*a-b*.

The support 216, like the crossbeam 208, comprises an elongated beam, rod, stick, or sleeve, which may be hollow or solid. In the preferred embodiment, the support 216 is steel, but also be formed from wood, iron, brass, polymers and the like.

The support 216 is affixed at one end to the frame or a crossbeam 108. Unlike the crossbeam 108, the support 216 substantially parallels the y-axis of the auger rack 200, while the crossbeams are orthogonal to the y-axis of the auger rack 200. The support 216 is affixed at one end to an auger arm 218, such as auger arm 218*b*. The length of the support 216 approximates the length of an auger 108 intended to be secured by the auger rack 200. In some embodiments, the support 216 is telescopic. In other embodiments, the support 216 is otherwise extrudable, adjustable, extendable, or retractable using means known to those of skill in the art. The support 216 may comprise and rack-and-pinion device. Some embodiments of the present invention comprise a plurality of supports 216.

The auger arms 218*a-b*, like the support 216, comprise elongated beams. Unlike the support 216, the auger arms 218*a-b* are disposed orthogonally to the y-axis of the auger rack 200. The auger arms 218*a-b* are pivotably affixed to one end of the support 216 in the shown embodiment. In alternative embodiments, the auger arms 218*a-b* are slidably or detachably affixed to the support 216. In some embodiments, the auger arms 218*a-b* are hingedly connected to a support 216 such that they may be lifted vertically away from an auger 108 resting in a receptacle 206. In some embodiments of the present invention, the auger arms 218*a-b* are affixed to other components of the auger rack 200, such as one of the U-shaped channels 212*a-b*.

In some embodiments of the present invention, the auger arms 218*a-b* are telescopic. In other embodiments, the auger arms 218*a-b* are extrudable, adjustable, extendable, or retractable using means known to those of skill in the art. Some embodiments of the present invention comprise a plurality of auger arms 218.

The clasp 220 comprises a clasp, clamp, or fastener, meant to detachably grip an auger 108 using means known to those of skill in the art. The claps 220 may comprise a circlip, a strap, a band clamp, a pipe clamp, a hose clamp, buckle, rope, or the like.

The cotter pin 222 is used to close the clasp 220 in the shown embodiment, and well-known to those of skill in the art.

The strut 224 comprises in physical form a crossbeam 108. However, the strut 224 is affixed at a proximal end to one of the members 202-204 and a crossbeam 108, and is affixed at a distal end to one of the U-shaped channels 212*a-b*, supports 216, and receptacle 206*a-b*.

Figure 3:
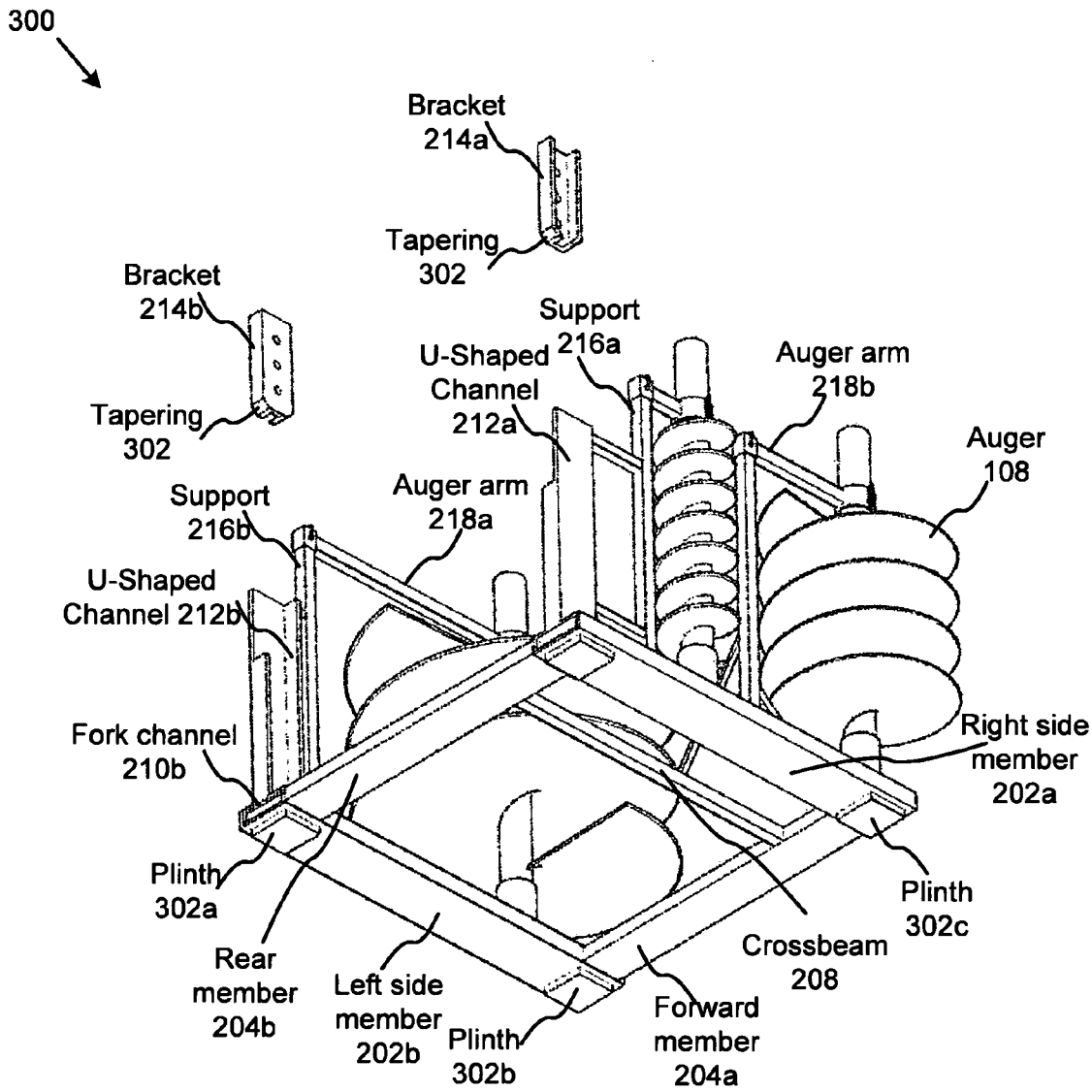
FIG. 3 is a lower elevational view of an auger rack, with secured augers, in accordance with the present invention.

FIG. 3 is a lower elevational view of an auger rack 300, with secured augers 108, in accordance with the present invention. The auger rack 300 comprises, in the shown embodiment, a right side member 202*a*, a left side member 202*b*, a forward member 204*a*, a rear member 204*b*, a crossbeam 208, a U-shaped channel 212*a*, a U-shaped channel 212*b*, a bracket 214*a*, a bracket 214*b*, a support 216*a*, a support 216*b*, an auger arm 218*a*, an auger arm 218*b*, a plinth 302*a*, a plinth 302*b*, a plinth 302*c*, a plinth 302*d*, tapering 304*a*, and tapering 304*b*. Also shown in an auger 108.

The right side member 202*a*, left side member 202*b*, forward member 204*a*, rear member 204*b*, crossbeam 208, U-shaped channel 212*a*, U-shaped channel 212*b*, bracket 214*a*, bracket 214*b*, support 216*a*, support 216*b*, auger arm 218*a*, auger 108, and auger arm 218*b* are all substantially described above in relation to FIG. 2.

This perspective view is meant to show the auger rack 300 in a configuration securing augers 108. In the shown embodiment, each of the members 202-204 are connected to two other members 202-204 at 90 degree angles. Each of the members 202-204 may be connected to another components at angles of between 20 and 150 degrees.

The plinths 302*a-d* comprise metal, fabric, or polymer spacers affixed to the bottom of the frame, and meant for engaging the ground. In some embodiments, the plinths 302*a-d* are designed to absorb some level of shock when the auger rack 300 in placed on the ground by a Bobcat or track vehicle. In other embodiments, the plinths 302*a-d* are meant to prevent damage from the ground to frame. The plinths

302*a-d* may be substantially square, circular, triangular, polygonal, or the like. The plinths 302*a-d* may comprise tread, or texturing, to prevent slippage of the auger rack 300 across inclined or slippery ground surfaces.

The tapering 304*a-b* comprise tapering bracket edges for more easily inserting the brackets 214*a-b* into the U-shaped channels 212*a-b*. The brackets 214*a-b* may be tapered at either or both ends.

Figure 4:
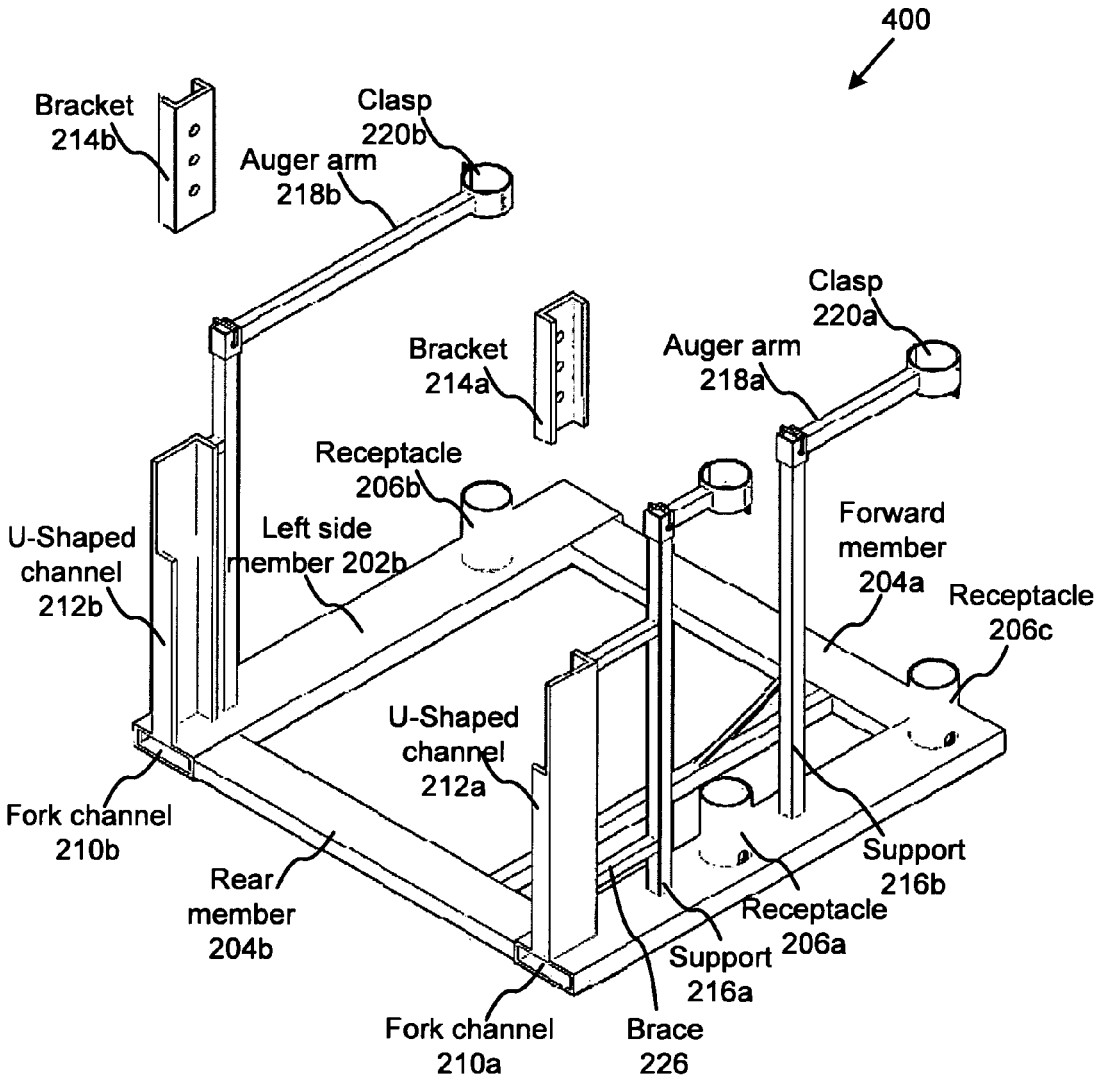
FIG. 4 is an elevational perspective view an auger rack in accordance with the present invention.

FIG. 4 is an elevational perspective view an auger rack 400 in accordance with the present invention. The auger rack 400 comprises, in the shown embodiment, a left side member 202*b*, a forward member 204*a*, a rear member 204*b*, a U-shaped channel 212*a*, a U-shaped channel 212*b*, a bracket 214*a*, a bracket 214*b*, a support 216*a*, a support 216*b*, an auger arm 218*a*, an auger arm 218*b*, a clasp 220*a*, and a clasp 220*b*.

Each of the left side member 202*b*, forward member 204*a*, rear member 204*b*, U-shaped channel 212*a*, U-shaped channel 212*b*, bracket 214*a*, bracket 214*b*, support 216*a*, support 216*b*, auger arm 218*a*, auger arm 218*b*, clasp 220*a*, and clasp 220*b* are substantially described above in relation to FIGS. 2-3.

The dimensions of the auger rack 400 shall not exceed ten meters, by ten meters, by ten meters.

In the shown embodiment, the brackets 214*a-b* are not tapered as they are in FIG. 3. The brackets 214*a-b* may be either tapered or untapered.

The auger rack 400 may be lifted by forks attached to a Bobcat, skid steer, compact track loader, mini excavator, and the like.

Figure 5:
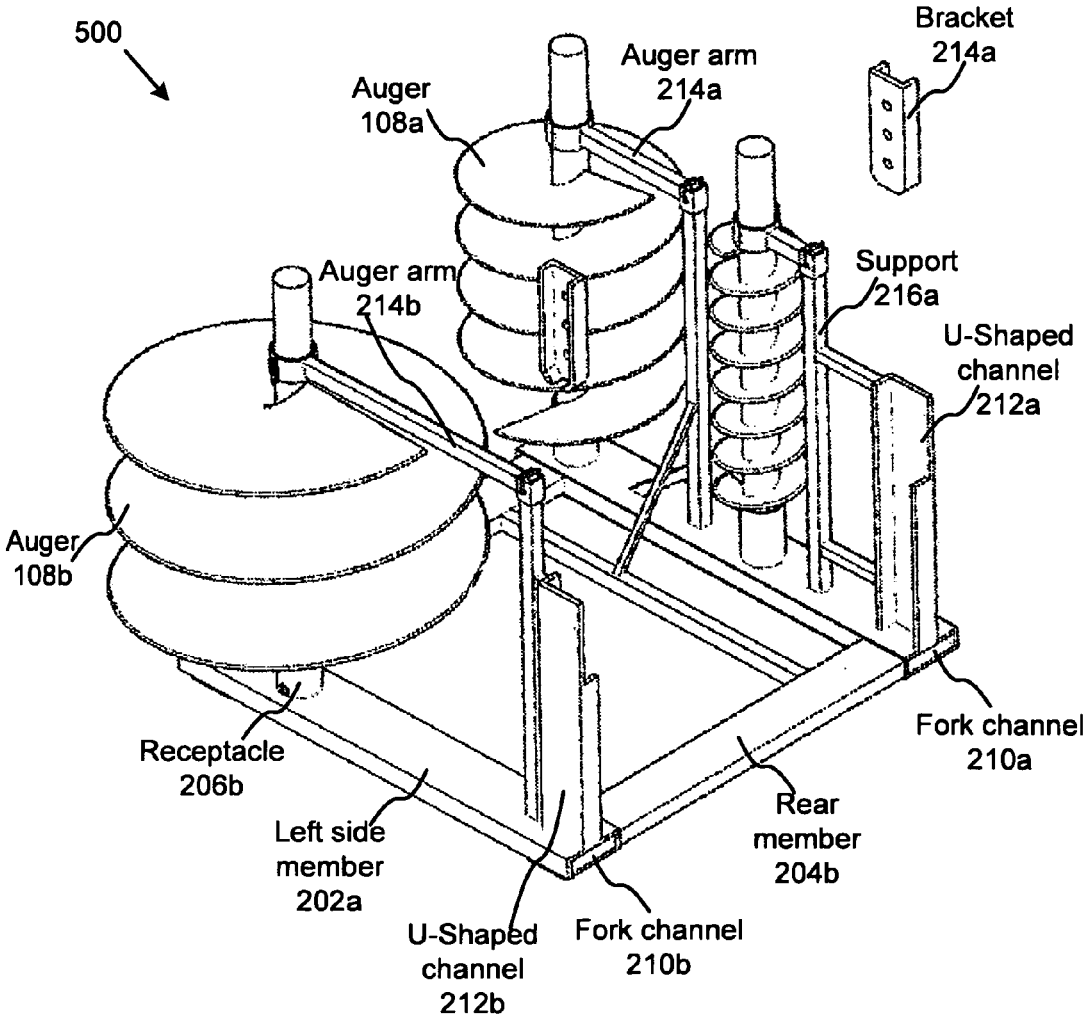
FIG. 5 is an elevational perspective view an auger rack, with secured augers, in accordance with the present invention.

FIG. 5 is an elevational perspective view an auger rack 500, with secured augers 108, in accordance with the present invention. The auger rack 500 comprises, in the shown embodiment, a left side member 202*b*, a rear member 204*b*, a fork channel 210*a*, a fork channel 210*b*, a U-shaped channel 212*a*, a U-shaped channel 212*b*, a bracket 214*a*, a support 216, an auger arm 218*a*, and an auger arm 218*b*. Also shown are augers 108*a-b*.

Each of the left side member 202*b*, rear member 204*b*, fork channel 210*a*, fork channel 210*b*, U-shaped channel 212*a*, U-shaped channel 212*b*, bracket 214*a*, support 216, auger arm 218*a*, auger arm 218*b*, augers 108*a*, and auger 108*b* are substantially described above in relation to FIGS. 2-4.

FIG. 5 is meant to shown another perspective view of an auger rack 500 loaded with augers 108*a-b*. In the shown embodiment, the auger arms 218*a-b* are hingedly connected to supports 216, such that the auger arms 218*a-b* rise vertically away from the augers 108*a-b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable auger rack for transporting augers, the portable auger rack comprising:

a generally rectangular frame comprising:

an elongated forward member between 0.5 meters and 5 meters in length, the forward member formed from a rigid metallic substance, the forward member permanently affixed to one or more of a right side member and a left side member;

an elongated rear member between 0.5 meters and 5 meters in length, the rear member formed from a rigid metallic substance, the rear member permanently affixed to one or more of the right side member and the left side member;

the right side member; wherein the right side member is permanently disposed within the frame in generally parallel orientation to the left side member, the right side member permanently affixed to the forward member at an angle of between 30 and 120 degrees, the right side member permanently affixed to the rear member at an angle of between 30 and 120 degrees;

the left side member, wherein the left side member in a generally parallel orientation to the right side member, the left side member permanently affixed to the forward member at an angle of between 30 and 120 degrees, the left side member permanently affixed to the rear member at an angle of between 30 and 120 degrees;

one or more cylindrical receptacles having open tops, for receiving a tip of an auger, each of the receptacles permanently affixed at a base to one of the rear member, the forward member, the left side member, and the right side member;

one or more rigid elongated arms, each of said one or more arms pivotably affixed to a component of the auger rack, wherein each of said one or more arms extends laterally above the frame from a point of affixation to a distal point above a receptacle; and one or more clasps, each clasp affixed to one of the arms, each of said one or more clasps for detachably gripping an auger resting in the receptacle.

2. The auger rack of claim 1, further comprising two vertically oriented U-shaped channels for receiving and securing a cradle of an auger drive unit, wherein the U-shaped channels are permanently affixed to the frame.

3. The auger rack of claim 2, wherein said one or more arms are pivotably connected to one of the two U-shaped channels.

4. The auger rack of claim 1, further comprising a plurality of elongated support members, the support members each affixed at a proximal end to the frame, the support members each affixed at a distal end to one of the arms.

5. The auger rack of claim 1, wherein the left side member and right side member each respectively define a hollow recess for receiving a fork of a fork lift.

6. The auger rack of claim 1, further comprising or more housings affixed to the frame, each housing defining a hollow recess for receiving a fork of a fork lift.

7. The auger rack of claim 1, further comprising or more crossbeams, each crossbeam affixed to two or more of the forward member, the rear member, the left side member and the right side member.

8. The auger rack of claim 1, further comprising or more plinths affixed to an underside of the frame for engaging ground, wherein the plinths are formed from one of hydrocarbons and steel.

9. The auger rack of claim 1, further comprising or more plinths affixed to an underside of the frame for engaging ground.

10. An auger rack, the portable auger rack comprising:

a frame comprising:

an elongated forward member, the forward member formed from a rigid substance, the forward member permanently affixed to one or more of a right side member and a left side member;

an elongated rear member, the rear member formed from a rigid substance, the rear member permanently affixed to one or more of the right side member and the left side member;

the right side member; wherein the right side member is permanently disposed within the frame in generally parallel orientation to the left side member, the right side member permanently affixed to the forward member at approximately a right angle, the right side member permanently affixed to the rear member at approximately a right angle;

the left side member, wherein the left side member in a generally parallel orientation to the right side member, the left side member permanently affixed to the forward member at approximately a right angle, the left side member permanently affixed to the rear member at approximately a right angle;

one or more receptacles, having open tops, for receiving a tip of an auger, each of the receptacles permanently affixed at a base to one of the rear member, the forward member, the left side member, and the right side member;

one or more rigid elongated arms, each of said one or more arms detachably affixed to a component of the auger rack, wherein each of said one or more arms extends laterally above the frame from a point of affixation to a distal point above a receptacle; and one or more clamps, each clamp affixed to one of the arms, each of the one or more clamps for engaging an auger.

* * * * *